US006409854B1

(12) United States Patent
Gill et al.

(10) Patent No.: US 6,409,854 B1
(45) Date of Patent: Jun. 25, 2002

(54) LOW BURNING RATE, REDUCED HAZARD, HIGH TEMPERATURE INCENDIARY

(75) Inventors: Robert C. Gill, White Plains; Carl Gotzmer, Accokeek; Pamela Carpenter; Eric Schlegel, both of Indian Head, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 99 days.

(21) Appl. No.: 09/697,246

(22) Filed: Oct. 27, 2000

(51) Int. Cl.[7] ..... C06B 45/10; C06B 21/00

(52) U.S. Cl. ..... 149/19.9; 149/19.3; 149/19.92; 149/22; 149/108.2; 149/108.6

(58) Field of Search ..... 149/19.3, 19.9, 149/19.92, 22, 108.2, 108.6; 102/364

(56) References Cited

U.S. PATENT DOCUMENTS

| | | | | | |
|---|---|---|---|---|---|
| 2,995,431 | A | | 8/1961 | Bice | 52/5 |
| 3,865,035 | A | * | 2/1975 | Munson et al. | 102/114 |
| 3,986,909 | A | | 10/1976 | Macri | 149/19.9 |
| 4,012,244 | A | * | 3/1977 | Kaufman et al. | 149/19.3 |
| 4,098,625 | A | | 7/1978 | French et al. | 149/19.3 |
| 4,131,498 | A | * | 12/1978 | Lucy | 149/114 |
| 4,262,541 | A | | 4/1981 | Jacobs | 73/826 |
| 4,331,080 | A | | 5/1982 | West et al. | 102/301 |
| 4,397,700 | A | | 8/1983 | Johnson et al. | 149/7 |
| 4,482,405 | A | | 11/1984 | Wright | 149/19.3 |
| 4,521,260 | A | | 6/1985 | Johnson et al. | 149/19.91 |
| H169 | H | * | 12/1986 | Mackenzie et al. | 149/108.6 |
| 4,944,815 | A | | 7/1990 | Consaga | 149/19.1 |
| 4,978,400 | A | * | 12/1990 | Juneau et al. | 149/109.6 |
| 5,187,320 | A | | 2/1993 | Yunan | 102/275.8 |
| 5,253,584 | A | * | 10/1993 | Allford | 149/19.3 |
| 5,468,313 | A | | 11/1995 | Wallace, II et al. | 149/53 |
| 5,529,649 | A | | 6/1996 | Lund et al. | 149/19.3 |
| 5,880,398 | A | * | 3/1999 | Crilly et al. | 102/364 |
| 6,354,222 | B1 | * | 3/2002 | Becker et al. | 102/323 |

* cited by examiner

*Primary Examiner*—Edward A. Miller
(74) *Attorney, Agent, or Firm*—Mark Homer

(57) ABSTRACT

A high temperature incendiary composition having a reactive material of titanium, a second reactive material of boron, an oxidizer of polytetrafluoroethylene in an amount of from about 10 weight percent or less of the composition and a binder of carboxyl-terminated polybutadiene acrylonitrile in an amount of from about 5 weight percent or more. The composition is safe to handle, ignites readily, burns at a low and controlled rate and produces a very high flame temperature.

11 Claims, No Drawings

LOW BURNING RATE, REDUCED HAZARD, HIGH TEMPERATURE INCENDIARY

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to incendiary compositions. More particularly, the incendiary composition of the present invention contains a CTBN binder to improve ESD sensitivity of titanium/boron/polytetrafluoroethylene compositions. Most particularly, the CTBN binder is present in amounts of about 5% or more combined with polytetrafluoroethylene in amounts of from about 10% or less.

2. Brief Description of the Related Art

Reducing the electrostatic discharge sensitivity (ESD) for dry metals is particularly importance in the manufacture of incendiary devices. Highly reactive metals provide an excellent source for high burn temperatures, however, the more reactive the metal powders are, the more ESD sensitive they become. ESD sensitive metal powders are likely to ignite during handling or mixing, increasing hazards to personnel and manufacturing equipment. Combinations of titanium and boron potentially possess extremely high ESD sensitivity, with ignition of approximately 0.0084 joules possible. Other types of metallic mixtures that are less ESD sensitive, such as iron oxide and aluminum, i.e., Thermite, burn too quickly and with relatively low flame temperatures. Some combinations of magnesium, teflon® and Viton® A, e.g., MTV, have a high flame temperature, but they don't have the slow burning rate.

In view of the foregoing, there is a need for improved incendiary compositions for having a low burn rate, reduced ESD sensitivity and high flame temperature. The present invention addresses this need.

SUMMARY OF THE INVENTION

The present invention includes a high temperature incendiary composition comprising a reactive material of titanium, a second reactive material of boron, an oxidizer of polytetrafluoroethylene in an amount of from about 10 weight percent or less of the composition and a CTBN binder in an amount of from about 5 weight percent or greater, wherein the ratio of titanium to boron ranges from about 81/19 to about 69/31.

The present invention also includes a method for producing a high temperature incendiary composition comprising the steps of adding a first combination of a reactive material of titanium with a second reactive material of boron and an oxidizer of polytetrafluoroethylene, wherein the polytetrafluoroethylene comprises an amount of from about 10 weight percent or less of the composition and the ratio of titanium to boron ranges from about 81/19 to about 69/31 and adding a CTBN binder in an amount of from about 5 weight percent or greater to the first combination.

Additionally, the present invention includes a high flame temperature product from the process comprising the steps of providing an incendiary composition of titanium, boron, polytetrafluoroethylene in an amount of from about 10 weight percent or less of the composition, and CTBN binder in an amount of from about 5 weight percent or greater, wherein the ratio of titanium to boron ranges from about 81/19 to about 69/31 and igniting the composition.

Furthermore, the present invention includes a high temperature incendiary composition product from the process comprising the steps of adding first combination of a reactive material of titanium with a second reactive material of boron and an oxidizer of polytetrafluoroethylene, wherein the polytetrafluoroethylene comprises an amount of from about 10 weight percent or less of the composition and the ratio of titanium to boron ranges from about 81/19 to about 69/31 and adding a CTBN binder in an amount of from about 5 weight percent or greater to the first combination.

The present invention provides an incendiary composition having a high flame temperature that is safer to mix and handle because of a reduced sensitivity to ESD initiation.

DETAILED DESCRIPTION OF THE PREFERRED EMBODIMENT

The present invention relates to incendiary compositions with improved electrostatic discharge (ESD) sensitivity. The incendiary compositions contain a CTBN binder to improve ESD sensitivity of titanium, boron and polytetrafluoroethylene composition mixtures. The incendiary compositions are safe to handle, ignite readily, burn at a low and controlled rate and produce a very high flame temperature.

Safe ESD sensitivity for manufacture and handling of the present invention is in the range greater than 0.023 joules. The human body is capable of producing approximately 0.0084 joules. The high temperature incendiary composition of the present invention contains a reactive material of titanium, a second reactive material of boron, an oxidizer of polytetrafluoroethylene, which further includes a binder of CTBN that increases the ESD for the titanium/boron/polytetrafluoroethylene combination to a value of more than 0.023 joules. Calculations show that mixture of the two reactive metals, titanium and boron, form an intermetallic compound together upon ignition. Solid titanium and boron react to form a liquid, i.e., molten, intermetallic compound, indicated by the formula:

$$Ti+2B \rightarrow TiB_2$$

Other by-products occur, most significantly with the reaction of boron with polytetrafluoroethylene, and the reaction of the CTBN binder with titanium.

The titanium preferably comprises a particle size of from greater than 44 microns to about 150 microns, with ESD sensitivity increasing to unsafe levels below 44 microns and burn rates increasing beyond a slow burn rate above a particle size of from about 150 microns. Particle sizes of about 200 microns provide a burning rate of approximately 4.7 inches per minute or 321 grams per minute. Appropriate particle sizes for the titanium within the particle size range of from about 44 microns to about 150 microns may be used as determine by those skilled in the art for a given purpose in light of the disclosure herein. Boron particles may include any acceptable size, such as from about 0.5 microns to about 1 micron in size, as determined by one of ordinary skill in the art. The chemicals are commercially available in finely divided powders. Titanium powder metal is available from Atlantic Equipment Engineers of Bergenfield, N.J. under the catalog number TI-109, having a purity of 99.7%. Boron is available from Callery Chemical Company of Pittsburgh, Pa. under the tradename SB 95 having from about 95% to about 97% boron and from about 5% to about 3% magnesium oxide (MgO) or SB 90 having from about 90% to about 92% boron and from about 10% to about 8% magnesium oxide (MgO), with both products having an amorphous state with an average particles size of approximately 0.6 microns. The higher percentage the boron the higher the energy of reaction in the titanium/boron combination. Titanium amounts preferably include from about 48 weight percent to about 69 weight percent, and more preferably from about 58 weight percent to about 69 weight percent, with boron in amounts of from about 13 weight percent to about 27 weight percent, more preferably from about 16 weight percent to about 27 weight percent. For example, titanium may comprise approximately 68.85 weight percent and boron approximately 16.15 weight percent of the total composition.

The weight ratio amount of titanium to boron needed for a high flame temperatures range from about 81/19 to about 69/31. Preferably within this range, the titanium and boron are present in the composition in substantially stoichiometric proportions for forming the intermetallic compounds. As the ratio of titanium to boron decreases, the combination metal becomes increasingly more difficult to ignite, with the proper ratio of titanium to boron for a given incendiary composition determinable by those skilled in the art in light of the disclosure herein.

The incendiary composition includes an oxidizer of polytetrafluoroethylene, also known as Teflon®, in an amount of from about 10 weight percent or less of the composition. Preferred amounts of polytetrafluoroethylene range from about 2 weight percent to about 10 weight percent, with more preferred amounts of polytetrafluoroethylene ranging from about 5 weight percent to about 10 weight percent. The particles of the polytetrafluoroethylene may be any suitable size, such as from about 20 microns to about 450 microns, with little affect on the burning rate or slag percentage. For example, a polytetrafluoroethylene particle size between 20 microns and 450 microns in a given composition may vary in burning rates between from about 163 grams per minute to about 161 grams per minute with a slag percentage varying between from about 36% to about 40%. As the amount of polytetrafluoroethylene increases, the reaction energy of the titanium/boron ignition decreases, with the proper amount of polytetrafluoroethylene for a given incendiary composition determinable by those skilled in the art in light of the disclosure herein. Polytetrafluoroethylene is available from E. I. duPont de Nemours & Company of Wilmington, Del. under the tradename Teflon ® (Teflon ® 7C is the preferred material).

The CTBN binder is included within the incendiary composition in an amount of from about 5 weight percent or greater. Preferred amounts of CTBN binder range from about 5 weight percent to about 20 weight percent, with more preferred amounts of CTBN binder being approximately 5 weight percent. As the amount of CTBN binder increases, the flame temperature and burning rate decrease, with the proper amount of CTBN binder for a given incendiary composition determinable by those skilled in the art in light of the disclosure herein. Carboxyl-terminated butadiene/acrylonitrile copolymer (CTBN) is available from the B. F. Goodrich Company in Breckville, Ohio under the Hycar® 1300 series of polymers. The CTBN may be accompanied by additive components determinable by one skilled in the art including plasticizers such as dioctyl adipate (DOA) available from Union Camp Corporation in Wayne, N.J.; wetting agents such as lecithin (soy phospholipids, phosphatides) available from American Lecithin Company in Danbury, Conn.; crosslinkers such as Araldite® MY 0510 (4-glycidyloxy-N,N-Diglycidylaniline) available from Ciba Specialty Chemicals Corporation in Brewster, N.Y.; and/or curing catalysts such as Fomrez ® C-2 (stannous octoate) available from Witco Chemicals, Organic Division in Huston, Tex. For examples, the 5% CTBN binder may be composed of 2.35% CTBN, 1.30% DOA, 1.00% lecithin, 0.31% Araldite MY 0510, and 0.04% Fomrez C-2, with the percentages of the additives in the binder are increased proportionately as the CTBN binder is increased. The percentages of the additives in the binder can also vary as necessary to achieve certain characteristics as determinable by one skilled in the art of formulating.

The incendiary composition may be manufactured in a safe manner by using the binder to decrease the electrostatic discharge hazard during handling and mixing. The method for preparing this invention is to first add one-fourth of the titanium, boron, and Teflon® to the mixing bowl then add the CTBN, DOA, lecithin, Fomrez C-2 on top of the solids and mix for thirty minutes, while maintaining the bowl at a temperature of 70° F. to 80° F. The liquid binder ingredients are added on top of the solids to minimize the sticking of the binder to the walls and bottom of the bowl. At the end of this cycle and at the end of each of the other four cycles, the mix is stopped and the blades and sides of the bowl scrapped using a conductive spatula. Before each of the next two fifteen minute mixing cycles, another fourth of the solids are added. The crosslinker is added in the fourth cycle and mixing continued for another thirty minutes. In the fifth cycle, the rest of the solids are placed in the bowl and the contents mixed for ten minutes, the blades and bowl are given a final scrapping, and the mixing continued for another fifty minutes. The order of addition of the ingredients is very important for safety reasons.

A high flame temperature product results with the ignition of the incendiary composition of the 81/19 to 69/31 ratio of titanium and boron, 10 weight percent or less polytetrafluoroethylene and 5 weight percent or greater CTBN. Temperatures of the incendiary composition igniting may range from about 3900° F. for the 20% CTBN binder composition to nearly 5000° F. for the 5% CTBN binder composition at a Ti/B ratio of 81/19, with temperatures from about 4000° F. to about 5000° F. preferred,. As the incendiary composition comprises lesser amounts of the CTBN binder, such as 10 weight percent or less, the flame temperature increases. As the incendiary composition comprises less polytetrafluoroethylene, such as from about 2 weight percent to about 5 weight percent, the reaction energy increases.

EXAMPLE 1

Titanium in an amount of 1.30 g was placed in a 50 ml steel beaker. Boron in an amount of 0.30 g was added, as well as polytetrafluoroethylene in an amount of 0.20 g. Next the CTBN binder ingredients were weighed and mixed separately: 0.47 g CTBN-carboxyl terminated butadiene/acrylonitrile copolymer, 0.32 g DOA-dioctyl adipate, 0.10 g lecithin-soy phospholipids, phosphatides , 0.04 g 2-NDPA-2-nitrodiphenyl amine, 0.06 g Araldite MY-0510, and 0.01 g of Fomrez® C-2. A 0.20 g sample of this binder mixture was then weighed in the steel beaker containing the solids and the ingredients were hand mixed for approximately fifteen minutes using a conductive spatula. The sides and bottom of the beaker were scrapped with the spatula during the mixing to ensure that all ingredients were well blended. A dark brown, powder-like material was produced.

This material showed a medium range ESD sensitivity of 0.095 joules.

EXAMPLE 2

(Four 1-gallon Mixes)

Titanium in an amount of 2,498.4 g, boron in an amount of 536.1 g, and polytetrafluoroethylene in an amount of 362.9 g was weighed into separate containers. Approximately one-fourth of each one of the solids was added to a 1-gallon size vertical mixer bowl. Next 85.3 g of CTBN, 47.2 g of DOA, 36.3 g of lecithin, 1.5 g of Fomrez® C-2 was added to the top of the solids and mixed for 30 minutes, while maintaining a temperature of 70° F. to 80° F. in the bowl. After this first mixing cycle and after each subsequent cycle, the mixer bowl and blades were scrapped down with a conductive spatula. Two more fourths of the solids were added and mixed in the next two 15 minutes cycles. The 11.2 g of the crosslinker, Araldite MY 0510, was added in the fourth cycle and mixing was continued for another 30 minutes. Lastly, the final portion of the solids were added and mixing continued for a final 40 minutes.

The total of 32 pounds of the incendiary composition had a Ti/B ratio of 81/19. This material showed a medium range ESD sensitivity of 0.037 joules. A 10 pound size sample of the material was successfully ignited and burned in out burn test facilities, giving a burning rate of 1.6 in/min or 190 g/min and leaving 44% slag.

EXAMPLE 3

(Three 5-gallon Mixes)

Titanium in an amount of 21.34 pounds, boron in an amount of 5.01 pounds, and polytetrafluoroethylene in an amount of 3.10 lbs was weighed into separate containers. Approximately one-fourth of each one of the solids was added to a 1-gallon size vertical mixer bowl. Next 330.5 g of CTBN, 182.8 g of DOA, 140.1 g of lecithin, 5.6 g of Fomrez® C-2 was added to the top of the solids and mixed for 30 minutes, while maintaining a temperature of 70° F. to 80° F. in the bowl. After this first mixing cycle and after each subsequent cycle, the mixer bowl and blades were scrapped down with a conductive spatula. Two more fourths of the solids were added and mixed in the next two 15 minutes cycles. The 43.6 g of crosslinker, Araldite MY 0510, was added in the fourth cycle and mixing was continued for another 30 minutes. Lastly, the final portion of the solids were added and mixed for 10 minutes, the bowl and blades scrapped down with a conductive spatula, and the mixed for a final 50 minutes.

Three 5-gallon mixes were made, producing a total of 93 pounds of incendiary composition with a Ti/B ratio of 81/19. This material showed a medium range ESD sensitivity of 0.037 joules. A 20 pound size sample of the material was successfully ignited and burned.

Present Invention/Comparative Examples

As the table below shows, the composition with the CTBN binder produced the lowest burning rate.

| Composition | Burning Rate (g/min) |
|---|---|
| 5% CTBN binder/58.56% Ti/26.44% B/10% Teflon | 114 |
| 5% HTPB binder/58.56% Ti/26.44% B/10% Teflon | 145 |
| 5% Viton ® A binder/65.45% Ti/29.55% B | 1340 |
| 5% NC binder/65.45% Ti/29.55% B | 910 |

The foregoing summary, description, and examples of the invention are not intended to be limiting, but are only exemplary of the inventive features which are defined in the claims.

What is claimed is:

1. A low burn rate, high temperature incendiary composition comprising:

a reactive material of titanium;

a second reactive material of boron;

an oxidizer of polytetrafluoroethylene in an amount of from about 10 weight percent or less of the composition; and, carboxyl terminated butadiene/acrylonitrile copolymer (CTBN) binder in an amount of from about 5 weight percent or greater; wherein the ratio of titanium to boron ranges from about 81/19 to about 69/31.

2. The incendiary composition of claim 1, wherein the amount of CTBN binder ranges from about 5 weight percent to about 20 weight percent.

3. The incendiary composition of claim 2, wherein the amount of CTBN ranges from about 5 weight percent to about 10 weight percent.

4. The incendiary composition of claim 1, wherein the amount of polytetrafluoroethylene ranges from about 2 weight percent to about 10 weight percent.

5. The incendiary composition of claim 4, wherein the amount of polytetrafluoroethylene ranges from about 5 weight percent to about 10 weight percent.

6. The incendiary composition of claim 5, wherein the polytetrafluoroethylene is present in an amount of approximately 10 weight percent.

7. The incendiary composition of claim 1, wherein the amount oftitanium ranges from about 48 weight percent to about 69 weight percent.

8. The incendiary composition of claim 7, wherein the amount of titanium ranges from about 58 weight percent to about 69 weight percent.

9. The incendiary composition of claim 1, wherein the amount of boron ranges from about 13 weight percent to about 27 weight percent.

10. The incendiary composition of claim 9, wherein the amount of boron ranges from about 16 weight percent to about 27 weight percent.

11. A high temperature incendiary composition product from the process comprising the steps of:

mixing a first combination of a reactive material of titanium with a second reactive material of boron and an oxidizer of polytetrafluoroethylene, wherein the polytetrafluoroethylene comprises an amount of from about 10weight percent or less of the composition and the ratio of titanium to boron ranges from about 81/19 to about 69/31; and, adding a carboxyl terminated butadiene/acrylonitrile copolymer (CTBN) binder in an amount of from about 5 weight percent or greater to the first combination.

* * * * *